United States Patent [19]

Crowder

[11] 4,222,544

[45] Sep. 16, 1980

[54] PICTURE RAIL APPARATUS

[76] Inventor: Kenneth Crowder, 2344 S. Sheridan Way, Mississauga, Ontario, Canada

[21] Appl. No.: 823,220

[22] Filed: Aug. 10, 1977

[51] Int. Cl.[3] ..... A47G 1/24

[52] U.S. Cl. ..... 248/495; 248/222.2; 248/224.2; 248/307

[58] Field of Search ..... 248/222.2, 224.2, 307, 248/476, 495, 489; 52/27, 38

[56] References Cited

U.S. PATENT DOCUMENTS

| | | | |
|---|---|---|---|
| 28,174 | 5/1860 | Hochstrasser | 248/489 X |
| 394,144 | 12/1888 | Sword | 248/307 X |
| 1,019,151 | 3/1912 | Holmes | 248/489 |
| 1,060,708 | 5/1913 | Reynolds | 52/27 |
| 1,800,387 | 4/1931 | Greist | 248/307 |
| 1,850,021 | 3/1932 | Marrone et al. | 248/222.2 X |
| 3,268,195 | 8/1966 | Hoffman | 248/489 X |
| 4,008,872 | 2/1977 | Thompson | 52/27 X |

FOREIGN PATENT DOCUMENTS

| | | | |
|---|---|---|---|
| 427359 | 4/1935 | United Kingdom | 248/307 |

*Primary Examiner*—William H. Schultz
*Attorney, Agent, or Firm*—Ridout & Maybee

[57] ABSTRACT

Known picture rail apparatus comprises a rail member to be mounted horizontally on the wall, the rail member being formed with a longitudinally-extending slot, and a support member on which a picture or other article can be supported. The support member is provided with a tongue permitting it to be slidingly mounted on the rail member with the tongue slidingly engaged in the slot. In this invention, an inter-engaging surface of one of the tongue and the slot is provided with a longitudinally-extending shoulder which may be in the form of a rib serving to resist withdrawal of the tongue laterally from the slot.

5 Claims, 6 Drawing Figures

PICTURE RAIL APPARATUS

BACKGROUND OF THE INVENTION

A known form of picture rail apparatus comprises a rail member which is mounted horizontally on the wall, the rail member being formed with a longitudinally-extending slot. The slot is elongated in transverse section, and has a narrow opening at the front of the rail member. The apparatus includes a support member on which the picture or other article can be supported. The support member is formed with a thin tongue, and in use is detachably mounted on the rail member with the tongue slidingly engaged in the slot.

An advantage of this apparatus is that the rail member can be made quite thin and can be inset in the wall, with its slotted face flush with the wall surface. This gives a neat and attractive appearance to the wall, and facilitates decoration of the wall surface, since the apparatus avoids the obtrusive projection from the wall which is encountered with the more conventional projecting picture rails.

In the known form of the apparatus, the slot has been inclined downwardly transversely rearwardly from the opening. This is intended to make the engagement more secure, since it is to be expected that the downward pull of the article being supported would cause the tongue to seat more firmly in the slot. However, the present applicant has found that the support which is obtained is not sufficiently secure in all cases, and, particularly when used with relatively heavy articles, the support members tend to fall out of the slot. Further, the support members can be accidentally disengaged by an inadvertent lateral pull, for example when re-arranging the supported articles.

Applicant is aware of U.S. Pat. No. 46,296, Colburn, which describes a coat and hat hook which has a T-shaped projection lodging in a U-shaped groove in a rail. The Colburn arrangement is, however, designed to be affixed to the exterior of the wall and is not adapted to be inset in a wall surface.

U.S. Pat. Nos. 1,800,386 to Hoffman and 1,800,387 to Greist show channel-section rails which receive sliding support devices, but these are of considerable vertical thickness and are received in a wide channel which is not easily concealed in a wall surface.

U.S. Pat. Nos. 3,684,229 to Peter et al and 3,892,739 to Hoes disclose a mountings for specialised metal fittings but the mountings are not directly adaptable for receiving and retaining a thin tongue of a picture hook or like member.

SUMMARY OF THE INVENTION

The applicant provides an undercut recess in the bottom wall of the rear of the slot in the rail member into which extends a forwardly and downwardly projecting dovetail member on the rear edge of the tongue of the hook member. This arrangement is capable of giving a more secure engagement than the known form referred to above, and moreover guards against accidental dislodgement as when the hook member is pushed upwardly, the tongue bears on the upper edge of the slot opening thus rocking the tongue downwardly and forwardly and driving the dovetail projection into deeper engagement within its recess.

The rail member is preferably formed of a relatively rigid material, such as metal, and the hook member of a plastics material.

BRIEF DESCRIPTION OF THE DRAWINGS

The present invention will now be more fully described, by way of example only, with reference to the accompanying drawings in which.

DESCRIPTION OF THE PREFERRED EMBODIMENTS

Figure 1:
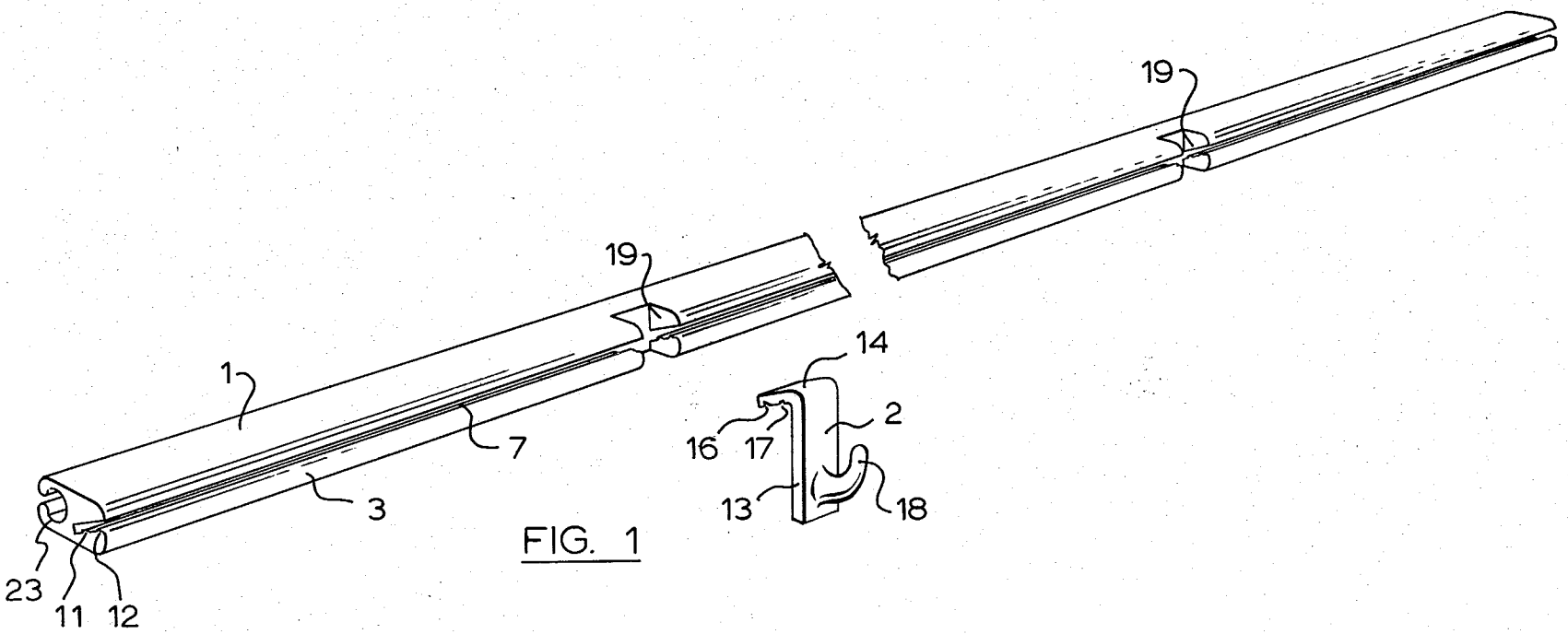
FIG. 1 is a perspective view of a rail member and a support member in accordance with the invention.

Referring to the accompanying drawings, wherein like reference numerals indicate like parts, rail member 1 and support members 2 are shown.

Each rail member 1 is formed in its front face 3 with a longitudinally-extending slot 7 which is of elongated rectangular transverse section, and inclines downwardly laterally away from its open side at the front face 3 of the rail member. The slot provides a narrow unobtrusive opening at the front of the rail member 1. In the embodiments shown in FIGS. 1 to 4, the lower side 9 of the slot 7 is formed with a pair of spaced, upwardly projecting, longitudinally-extending ribs 11 and 12.

Figure 4:
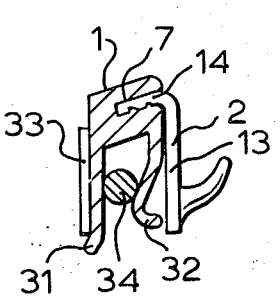
FIG. 4 shows in section a further form of apparatus in accordance with the invention.
Figure 3:
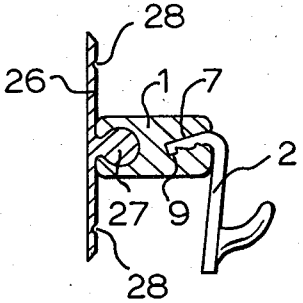
FIGS. 2 and 3 are sectional views of the apparatus of FIG. 1 illustrating the use of attachments for securing the rail member to a wall.

The support member 2 comprises a plate portion 13 and a rearwardly extending thin tongue 14. In FIGS. 1 to 4, the tongue 14 closely conforms to the slot 7, and as can be seen in FIGS. 2 to 4, when the support member 2 is mounted on the rail member, the upper and lower sides of the tongue 14 are in close engagement with the upper and lower sides of the slot 7. This gives a firm engagement between the support member 2 and the rail member 1, and just sufficient clearance is allowed between the tongue member 14 and the slot 7 to permit the support member 2 to be slid longitudinally along the rail member.

The lower side of the tongue 14 is formed with a pair of longitudinally-extending grooves 16 and 17 which are spaced apart and arranged so that they co-operate with the longitudinally-extending shoulder portions provided by the ribs 11 and 12.

In use, the rail member 1 is mounted horizontally on the wall. Attachment means, to be described in greater detail hereafter, may be used to secure it in place. The user can insert into the rail member as many of the support members 2 as are necessary for the attachment of the article or articles to be supported.

In the form shown in the drawings, the support member 2 includes a hook portion 18 extending from the front face of the plate portion 13, on which a picture or other article to be supported can be hung. Obviously, the support member 2 could be provided with other arrangements adapted for supporting articles. For example, the support member 2 could be provided with a hole through which a support cord could be passed, or in which an attachment hook could be engaged.

The tongue 14 of the support member 2 is inclined downwardly with respect to the plate portion 13 at an angle corresponding to the angle of inclination of the slot 7, so that, when the support member 2 is mounted on the rail member 1, the rear face of the plate portion 13 rests against the rail member. The tongue 14 will tend to seat in the slot 7 under the downward pull of the weight of a supported article. However, when a heavy article is supported, this seating by itself may not be sufficiently secure, since under a heavy downward pull, the material of the rail member 1 and the support member 2 may flex, and there would be the risk of the tongue 14 unseating from the slot 7. In the present invention, this risk is greatly reduced. When the support member 2 is mounted on the rail 1 as shown in FIGS. 2 to 4, the grooves 16 and 17 co-operate with the ribs 11 and 12 so as to provide an interlocking engagement. This resists lateral withdrawal of the tongue 14 from the slot 7, while permitting the support member 2 to be slid longitudinally along the rail 1. In the preferred form, the engagement is such that the support members cannot be laterally removed from the slot by hand pressure.

The interlocking engagement also avoids the risk of the support member 2 being accidentally dislodged from the slot 7 by an inadvertent lateral pull on the support member 2, for example when adjusting the position of the support member 2 along the rail 1.

Figure 2:
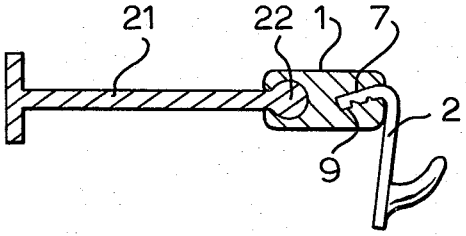

The rail members 1 shown in FIGS. 1 to 3 are adapted to be mounted in inset position in a recess in a wall, with the front face 3 of the rail member substantially flush with the wall surface. Since only the front face 3 of the rail member will be exposed, it is convenient to provide recesses 19 whereby support members 2 can be engaged with or disengaged from the rail member 1 from the front face 3 of the rail member. These recesses 19 are spaced inwardly from each end of the rail member, and each extends rearwardly from the front face 3 of the rail member 1 to the closed end of the slot 7. In the form shown in the drawings, the recesses extend through the full vertical thickness of the rail member 1, but it will be appreciated that it would be possible to employ a recess communicating with the slot 7 from only the upper or lower side of the slot. Further, depending on the length of the rail member which is employed, more than two recesses 19 may be desirable support members can be inserted or withdrawn, or, if only a short length of the rail member is used, a recess 19 at only one position along the rail member may suffice.

FIG. 2 shows in section a mortar anchor 21 for anchoring the rail member 1 in a mortar joint between two adjacent courses of blocks or bricks in a wall structure. The anchor 21 consists of a short length of T-section rigid material provided with a rounded bead 22 along one edge which can be slid into a longitudinally-extending necked cavity 23 on the rear face of the rail member 1. While building the wall, the rail member 1, to which a number of the anchors 21 are coupled at points spaced apart along it length, is laid on a completed course of the block or brick work with the front face 3 of the rail member 1 flush with the line of the front face of the wall. Mortar is then applied on and around the rail member 1 and the anchors 21, and the building operation is continued, with a further course of block or brick work being applied over the rail member 1 and its anchors 21, so that in the completed wall the rail member is built into and secured in the wall structure.

In FIG. 3, there is shown an anchor plate 26 which can be used for securing the rail member 1 to a stud or other support member in a plaster wall installation. The anchor plate 26 is provided with a projecting bead 27, for coupling with the cavity 23 in the rear face of the rail member 1. In the installation, the rail member 1, provided with a plurality of the anchor plates 26, can be attached to the studs with fasteners, for example nails or screws such as may be used for attaching plaster board to the studs. The wall surfacing materials, such as a plaster ground coat and a finishing or putty coat can then be applied to such a thickness that the front face 3 of the rail member 1 is left flush with the surface of the finished wall. As shown, the front face of the anchor 26 plate may be formed with grooves 28 to assist in locating the fasteners.

Instead of providing separate anchor plates, the rail member 1 may itself be formed integrally with vertically extending upper and lower flanges on its rear face, these flanges extending along the full length of the rail member 1. In this form, the rail member may be applied in a dry wall installation. The rail member can be interposed between the horizontal edges of two dry wall plaster boards, with the rear flanges on the rail member being secured to the boards, and/or to support members therefor, by fasteners passed through the rear flanges of the rail member.

FIG. 4 shows a rail member 1 which may be placed wholly exteriorly of the wall surface. The rail member 1 includes two laterally spaced downwardly extending flanges 31 and 31. The rear flange 31 has a pressure sensitive strip 33 on its rear face for adhering the rail member on a wall surface. The front flange 32 is curled inwardly to loosely retain a roller 34 inserted into the space between the flanges. This arrangement permits sheets of paper to be clipped to the rail member by inserting them edge-wise into the space between the two flanges, the papers being retained by frictional engagement with the surface of the roller 34 and an inner surface of an adjacent flange 31 or 32. As shown in FIG. 4, the lower ends of the flanges 31 and 32 may be turned outwardly to assist in introducing papers into the space between them. The lower end of the front flange 32 extends forwardly into alignment with the plane of the front face of the rail member 1, so as to offer lateral support to the rear face of the plate portion 13 of the support member 2.

In each of the embodiments shown in FIGS. 1 to 4, the longitudinally-extending ribs 11 and 12 may be formed in any appropriate cross section which is effective to resist withdrawal of the tongue 14 laterally from the slot 7. For example, these ribs may be rounded, square, or of saw-tooth section. An especially effective retention is obtained when the ribs are provided with a sharp peak. Where the ribs are of saw-tooth section, they are preferably formed with a gently inclined face on the side nearer the open end of the slot 7 and with a sharply inclined face, which may be perpendicular to the lower side 9 of the slot 7 on the opposite face. In the embodiments shown in the drawings the rear rib 11 is shown as a sawtooth section, and the front rib 12 is of more rounded section.

Figure 5:
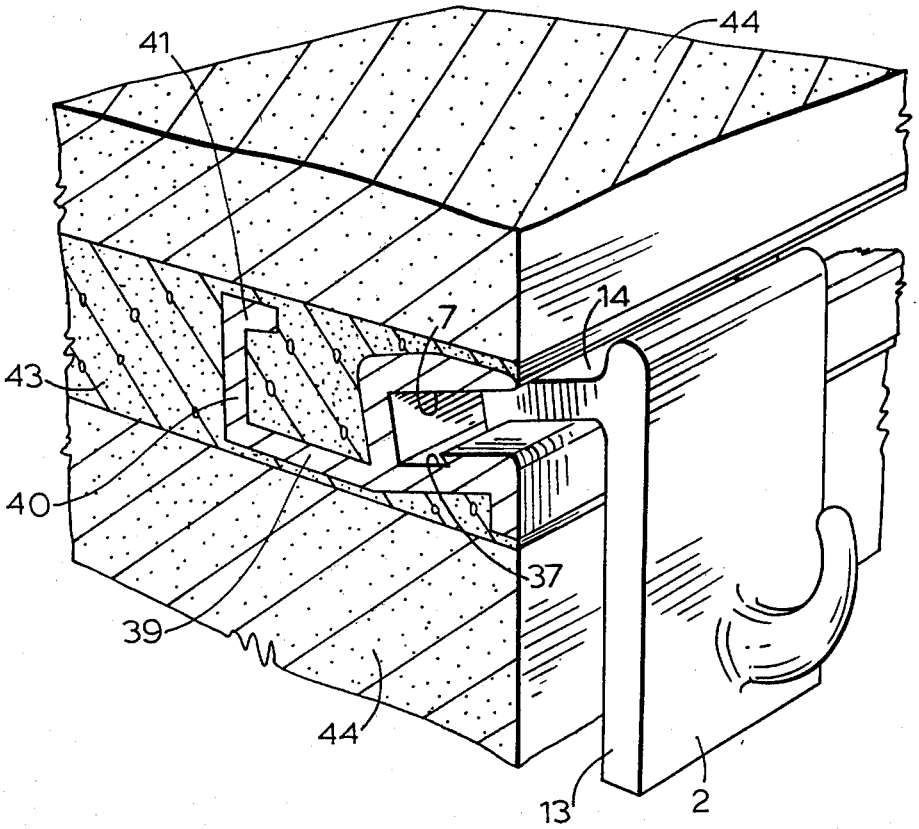
FIG. 5 shows in perspective and partly in section a further form of picture rail apparatus installed in wall surface.
Figure 6:
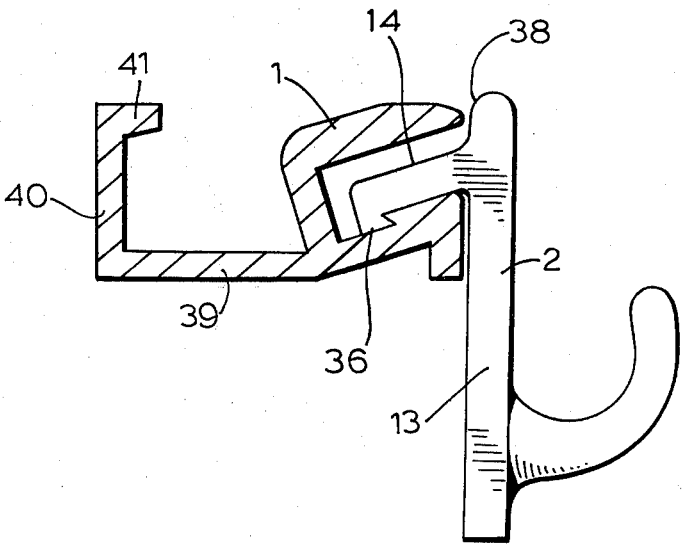
FIG. 6 shows a transverse section through the apparatus of FIG. 5.

In the embodiments shown in FIGS. 5 and 6, the tongue 14 of the support member 2 is formed at its rearward end with a dovetail-section downwardly and forwarding extending projection 36 which seats in a undercut recess 37 of corresponding section in the lower surface of the slot 7. The inclined front edge of the recess 37 provides a shoulder portion which inclines forwardly with respect to the lower side of the slot 7 and the shoulder portion engages a complementary inclined surface of the projection 36. This arrangement provides for quick release of the support member 2 from the rail member 1, since in this case a clearance is left between the sides of the slot 7 and the upper and lower sides of the tongue 14 which is greater than the downward extent of the projection 36, so that when the support member 2 is pushed upwardly and outwardly it can be disengaged from the rail member 1, and there is then no need to provide recesses such as the recesses 19 in the front of the rail member for insertion or withdrawal of the support members 2. The rear face of the plate portion 13 of the support member 2 of FIGS. 5 and 6 is spaced at a distance from front face of the rail member 1 at a distance sufficient to permit disengagement of the projection 36 from the recess 37, i.e. greater than the forward extent of the projection 36. An upward extension 38 of the plate member 37 is also provided adjacent the upper front edge of the rail member 1 in the engaged position, and this has the particular advantage of reducing the risk of the support member 2 becoming disengaged through accidental upward and rearward rocking of the support member 2.

In FIGS. 5 and 6, the rail member 1 has an integral rearward extension 39 having an edge flange 40 formed with a retrorse lip 41. This provides a mortar anchor for anchoring the rail member in the mortar 43 between adjacent courses of blocks or bricks 44.

In some forms of the invention, the slot 7 need not be inclined downwardly away from the front face of the rail member, since the support member 2 is retained securely by the ribs 11 and 12 or by the projection 36. When the rail member 1 is made from metal, it is desirable to use a low friction plastics material for the support members 2 or for the rail member 1, so that a smooth sliding action is obtained.

The rail members 1 can conveniently be formed by extrusion. The applicants presently prefer to form the rail member 1 as metal extrusions, and to mould the support members from nylon.

I claim:

1. In combination, a picture rail member with a horizontally continuous opening in its front wall, a rearwardly elongated slot defined by top, bottom and back walls rearwardly of the opening, a horizontally continuous recess in the bottom wall of the slot adjacent its back wall, said recess extending forwardly and downwardly in undercut relationship beneath the back edge of said bottom wall, and a hook member comprising a rearwardly elongated tongue engaging slidably on said bottom wall and having its top surface spaced from said top wall, a front plate portion having hook means thereon and a rear face spaced from the front wall of the rail member, and a dovetail portion adjacent the rear edge of said tongue portion with a projection forwardly and downwardly in snug engagement within said undercut recess, the forward extent of said projection being less than the spacing between the rail member and the plate portion and the downward extent thereof being less than the spacing between the tongue portion and the slot top wall.

2. The combination of claim 1 in which the slot extends downwardly rearwardly from the opening.

3. The combination of claim 1 wherein the plate portion extends above and below the opening.

4. The combination of claim 1 wherein the front edges of said recess and said projection comprise inclined planes.

5. The combination of claim 1 wherein the rail member is a metal extrusion and the hook member is a plastics molding.

* * * * *